US007138644B1

(12) United States Patent
Su et al.

(10) Patent No.: US 7,138,644 B1
(45) Date of Patent: Nov. 21, 2006

(54) ROTATABLE AND REPLACEABLE PLUNGER TYPE MULTI-SOURCE RADIATOR

(75) Inventors: Shi Hwa Su, Taoyuan (TW); Chun Liang Chen, Taoyuan (TW); Wen Song Hwang, Taoyuan (TW)

(73) Assignee: Institute of Nuclear Energy Research, Taoyuan (TW)

( * ) Notice: Subject to any disclaimer, the term of this patent is extended or adjusted under 35 U.S.C. 154(b) by 15 days.

(21) Appl. No.: 11/162,071

(22) Filed: Aug. 27, 2005

(51) Int. Cl.
*G21F 5/00* (2006.01)
*G21F 5/04* (2006.01)
*G21F 5/15* (2006.01)

(52) U.S. Cl. ..... 250/507.1; 250/506.1

(58) Field of Classification Search ..... 250/506.1, 250/507.1
See application file for complete search history.

(56) References Cited

U.S. PATENT DOCUMENTS 6,106,152 A 8/2000 Thunberg ..... 378/205
6,434,216 B1 * 8/2002 Maki et al. ..... 378/9

* cited by examiner

*Primary Examiner*—David A. Vanore

(57) ABSTRACT

A rotatable and replaceable plunger type multi-source radiator is provided for equipment correlation and radiation experiment. The rotatable and replaceable plunger type multi-source radiator comprising a radiation source rod, a rotatable radiation source selection device, staircases radiation aperture, radiation shields, and a mechanic operation arm for replacing radiation source. The plunger type rotatable and replaceable multi-source radiator of the present invention is capable of preventing radiation leakage and mutual interferences among radiation sources, providing precise positioning, safety operation, and simple replacement of radiation sources.

10 Claims, 4 Drawing Sheets

ROTATABLE AND REPLACEABLE PLUNGER TYPE MULTI-SOURCE RADIATOR

BACKGROUND OF THE INVENTION

1. Field of the Invention

The present invention relates to a plunger type rotatable and replaceable multi-source radiator, especially a multi-source radiator for replacement of radiation source in a rotatable movement.

2. Description of the Prior Art

The multi-source radiator is suitable for equipment correlation and radiation experiment. Conventionally, there are two ways of selecting and transporting the inner radiation source of radiator, one of these is by gas passage and the other is by air or oil cylinder passage as shown in FIG. 1 and FIG. 2 respectively. The flaws of these conventional ways are as follows:

(1) The radiation source shield 1 is used for storing and preventing radiations, but it may leak from gas pipe passage 14 (or cylinder passage 17).

(2) The radiation source selection device 3 moves the selected radiation source 8 to the gas pipe passage 14 (or cylinder passage 17) and separates each radiation source to prevent mutual disturbance. However the radiation source room space 16 and the gas pipe passage 14 (or cylinder passage 17) may have shortage of shield due to limited space, especially, this phenomenon will take place easily for room contraction in case of numerous radiation sources.

(3) When the air pump 15 moves the radiation source 8 to the radiation aperture 4, there would be a danger of the radiation source stuck in the gas pipe passage 14 (or cylinder passage 17), which is caused by inappropriate location of the radiation source selection device 3 and the orientation shift of the radiation source 8.

(4) It is difficult to take out or reinstall the radiation source after it has been installed in the radiation source room 7.

(5) The radiation source may not be capable of returning to the radiation source room for insufficient atmospheric pressure while in a power failure.

Therefore, it has been long for engineers to solve above-mentioned flaws, and it is now to be solved by the present invention.

SUMMARY OF THE INVENTION

The main object of the present invention is to provide a plunger type multi-source radiator with a radiation source rod designed to avoid radiation leakage caused by conventional gas pipe passage (or cylinder passage).

Another object of the present invention is to provide a plunger type multi-source radiator with a radiation source rod design to avoid mutual disturbance between radiation sources for insufficient shield of the gas pipe passage (or cylinder passage).

Another object of the present invention is to provide a radiation source rod replaceable with a positioning lever device and a mechanical arm to prevent the radiation source to be stuck or blocked.

Another object of the present invention is to provide a radiation source rod replaceable from upper position to ease the replacement of radiation source.

Another object of the present invention is to provide a method to return the radiation source back to the radiation source room automatically by gravitation, preventing the radiation source dwelled in radiation aperture area during power failure.

In order to achieve the above-mentioned objects, the present invention provides a radiator consisting of one or plural radiation sources for use in equipment correlation and radiation experiment. The radiation source shield and the rotatable radiation source selection device form a main block of radiation sources, wherein a cavity formed on the radiation source shield for accommodating the rotatable radiation source selection device, a radiation aperture formed on left side of the main block for radiation, and bottom side of the main block kept hollowed for routing transmission lines. The main parts of the radiator may perform the following roles: a radiation source rod used to hold the radiation source between two shields to avoid radiating to both ends, reduce mutual obstruction and leakage; a rotatable radiation source selection device used to separate the radiation source and a positioning lever device used to move the radiation source exactly to the reserve radiation location; staircases shield type radiation aperture and the shields beneath the radiation source rod used may impede disturbances from other scattering radiation source to the selected radiation source at radiation aperture; the radiation source shield keep the radiation source in the radiator safely; a precise mechanical arm may move the radiation source to the radiation aperture or retract it to the reserve radiation location, even during power failure, it can be accomplished by gravitation.

Therefore, the rotatable and replaceable plunger type multi-source radiator of the present invention is capable of conserving the radiation source in the radiator safely, positioning precisely, operating securely without leakage and mutual disturbance of radiation, and easy for assembly and disassembly.

DETAILED DESCRIPTION OF THE PREFERRED EMBODIMENT

Figure 1:
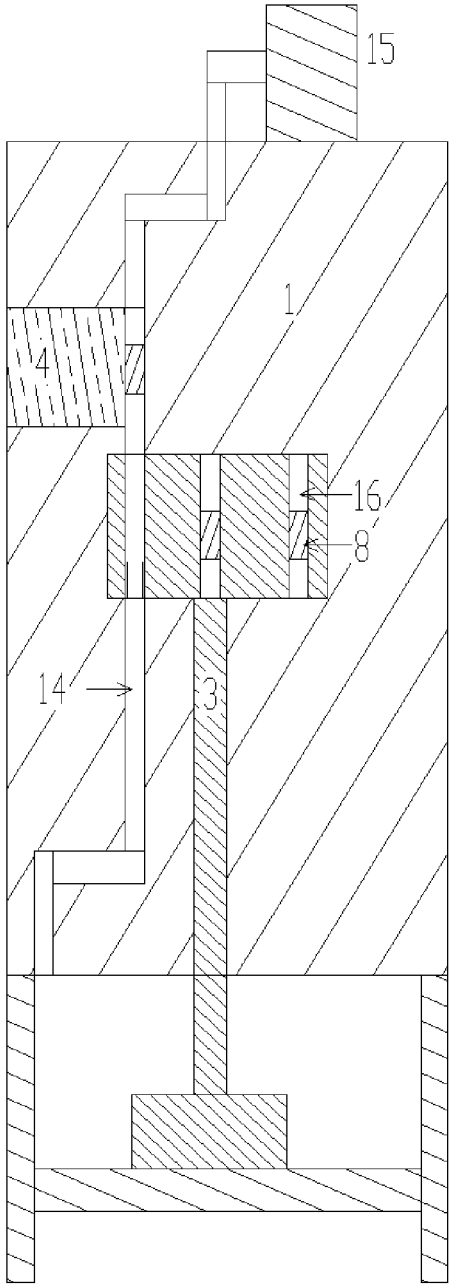
FIG. 1 is a prior art of multi-source radiator of gas pipe passage type.
Figure 2:
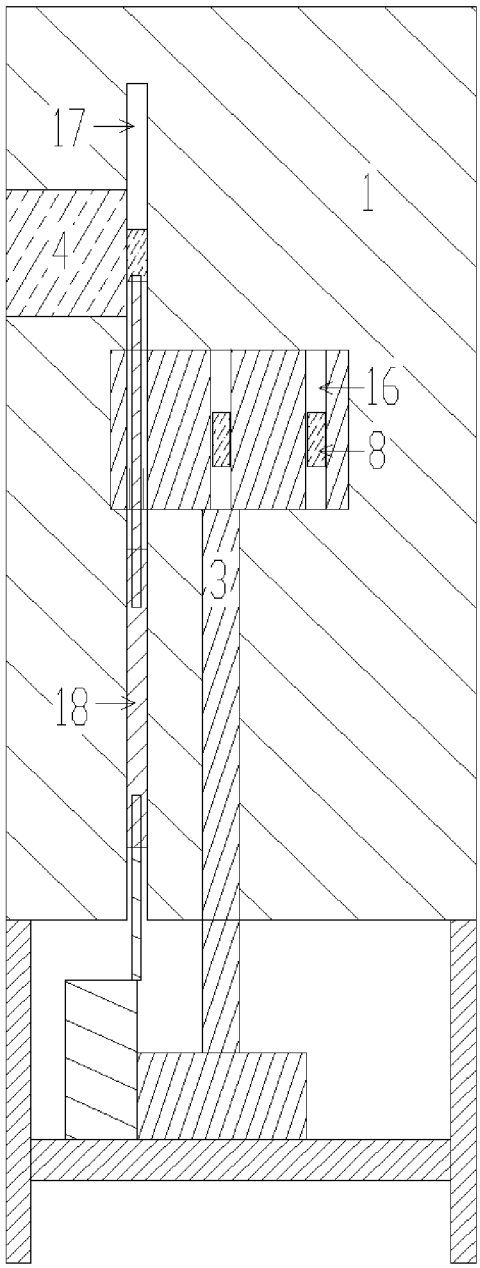
FIG. 2 is another prior art of multi-source radiator of cylinder passage type.

FIG. 1 and FIG. 2 are prior arts of multi-source radiator of the gas pipe passage type and the cylinder passage type, respectively. It is shown that possibility of mutual disturbance between radiation sources 8 is high for insufficient shield 1 of the conventional gas pipe passage 14 (or cylinder passage). During operation, a rotatable radiation source selection device 3 selecting the desired radiation source 8 and moving it to a position against a radiation aperture 4 for operation through air or cylinder pressure, respectively.

Figure 3:
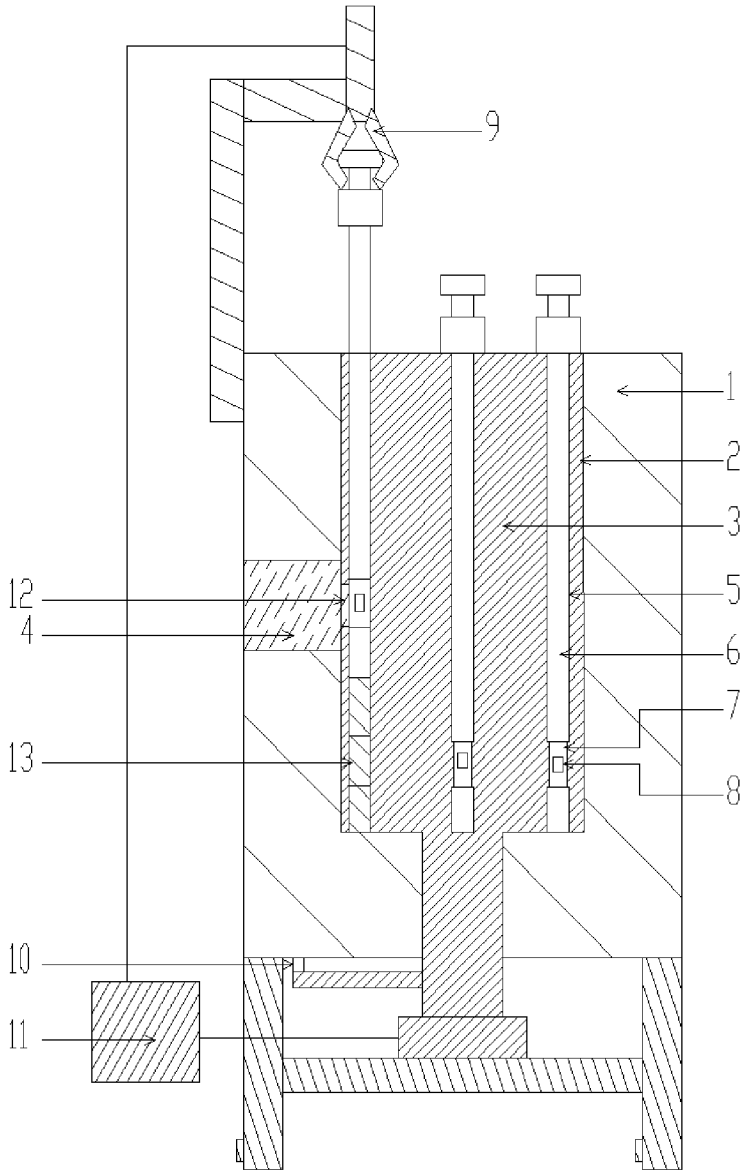
FIG. 3 is an exploded view of the present invention.

As shown in FIG. 3, it illustrates an exploded view of the construction of the present invention. The multi-source radiator contains: a radiation source shield 1, plural shield cavities 2 for accommodation of plural plunger pipes 5 and radiation source rods 6, a rotatable radiation source selection device 3 for selecting a desired radiation source 8, a radiation aperture 4 for radiation source 8 to radiate, one or plural plunger pipes 5 for accommodation of plural radiation source rods 6, one or plural radiation source rod 6, one or plural radiation source box 7 for accommodation of radiation source 8, one or plural radiation source 8, a mechanical arm 9 for operating and moving radiation source rod 6, a positioning lever device 10 for precisely positioning the rotatable radiation source selection device 3, a control device 11 for controlling timing and positioning of the rotatable radiation source selection device 3 and the radiation source rod 6, a radiation position 12, and a reserve radiation location 13.

Figure 4:
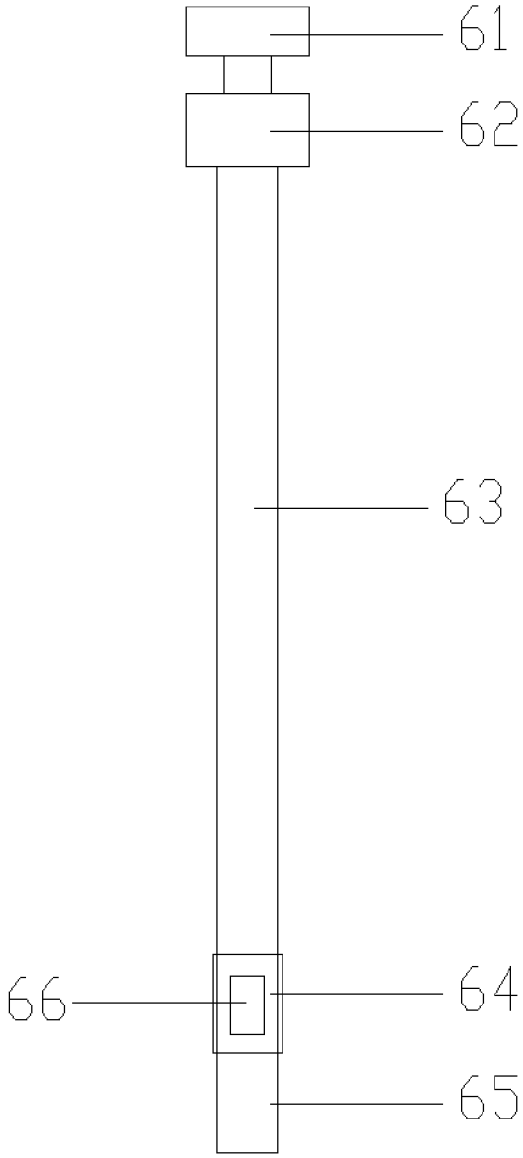
FIG. 4 is an exploded view of a radiation source rod of the present invention.

In FIG. 4, it illustrates the radiation source rod 6 comprising: a handle 61 for operation with the mechanical arm 9, a packing gland 62, top shield 63 for preventing leakage of radiation, radiation source box 64, bottom shield 65 for preventing leakage of radiation, and a radiation source 66. The control device 11 may be used to set up exposure time with built-in timer (not shown), and a built-in displacement controller (not shown) may be used to control the rotatable radiation source selection device 3 to set up and select the radiation source 8, a CPU may be used to control the mechanical arm 9 in accordance with the built-in timer.

When there is no operation, the radiation source rod 6 may fulfill the space inside the rotatable radiation source selection device 3 to avoid radiation leakage.

During operation, firstly, the control device 11 selects the radiation source 8 and sets the exposure time, followed by pushing start button to make the rotatable radiation source selection device 3 move the chosen radiation source rod 6 to the proximity of the radiation position 12, and then the mechanical arm 9 lifts up the radiation source rod 6 to the adjacent position of radiation aperture 4 to start up radiation according to the built-in timer. The disturbance from other radiation sources can be obstructed with the top shield of standby radiation sources 8 and the bottom shield of the operating radiation source 8. The mechanical arm 9 may move the radiation source 8 to return to its reserve radiation location 13 to complete a radiation cycle when the radiation time is up, and it also can take the radiation source 8 back to the reserve radiation location 13 from the radiation position 12 by gravitation when an unexpected power failure occurred.

Various additional modifications of the embodiments specifically illustrated and described herein will be apparent to those skilled in the art, particularly in light of the teachings of this invention. The invention should not be construed as limited to the specific form and examples as shown and described, but instead is set forth in the following claims.

What is claimed is:

1. A rotatable and replaceable plunger type multi-source radiator comprising a radiation source shield, plural shield cavities, a rotatable radiation source selection device, a radiation aperture, one or plural plunger pipes, one or plural radiation source rod, one or plural radiation source box, one or plural radiation sources, a mechanical arm, a positioning lever device, a control device, a radiation aperture, and a reserve radiation location, wherein the radiation source rod consists of a handle, a packing gland, a top shield, a radiation source box and a bottom shield, wherein the control device consists of a timer, a displacement controller and a CPU.

2. The rotatable and replaceable plunger type multi-source radiator according to claim 1, wherein the radiation source shield and the rotatable radiation source selection device form a main block of radiation sources, wherein the shield cavity is formed on the radiation source shield for accommodating the rotatable radiation source selection device, a radiation aperture formed on left side of the main block for radiation, and bottom side of the main block kept hollowed for routing transmission lines.

3. The rotatable and replaceable plunger type multi-source radiator according to claim 1, wherein the rotatable radiation source selection device containing one or plural plunger pipes in an annular and symmetrical configuration with its center is inserted from top into the cavity of the radiation source shield for ease of loading and unloading radiation source rods.

4. The plunger type rotatable and replaceable multi-source radiator according to claim 1, wherein the radiation source rod comprising a handle, a packing gland, top shield, a radiation source box, bottom shield may be inserted in the plunger pipe directly.

5. The plunger type rotatable and replaceable multi-source radiator according to claim 1, wherein the radiation aperture with staircases may use the shield beneath the radiation source rod to prevent leakage and interference from the other radiation sources within the radiation source rod.

6. The plunger type rotatable and replaceable multi-source radiator according to claim 1, wherein the mechanical arm is used for moving the radiation source rod up and down for positioning the radiation source in alignment with the radiation aperture.

7. The plunger type rotatable and replaceable multi-source radiator according to claim 1, wherein the radiation source shield, the rotatable radiation source selection device and the radiation source rod use heavy metal material covered with iron plate.

8. The plunger type rotatable and replaceable multi-source radiator according to claim 1, wherein the radiation source selection device may be adjusted in precision with the positioning lever device.

9. The plunger type rotatable and replaceable multi-source radiator according to claim 1, wherein the mechanical arm is capable of returning to the reserve radiation location by gravitation while a power failure occurred.

10. The plunger type rotatable and replaceable multi-source radiator according to claim 1, wherein the control device is used to command the exposure time of the radiation source and to start the operation of the radiation source selection device and the mechanical arm.

* * * * *